United States Patent [19]

Heyn et al.

[11] 4,106,556

[45] Aug. 15, 1978

[54] CERAMIC TUBE RECUPERATORS

[75] Inventors: Fred M. Heyn, Export; Ching-Feng Yin, Pittsburgh; Gordon L. Hanson, Bethel Park; Robert C. Schreck, Monroeville, all of Pa.

[73] Assignee: Thermal Transfer, Division of Kleinewefers, Monroeville, Pa.

[21] Appl. No.: 745,297

[22] Filed: Nov. 26, 1976

[51] Int. Cl.[2] ..... F28F 9/10

[52] U.S. Cl. ..... 165/81; 165/142; 285/140

[58] Field of Search ..... 285/140, 353, 423; 165/142, 81, 179

[56] References Cited

U.S. PATENT DOCUMENTS

| | | | |
|---|---|---|---|
| 906,099 | 12/1908 | Burgess | 285/353 |
| 1,992,200 | 2/1935 | Ford | 285/140 |
| 2,537,678 | 1/1951 | Koetting | 285/140 X |
| 3,078,072 | 2/1963 | Brown, Jr. | 165/81 |
| 3,309,072 | 3/1967 | Cummings | 165/179 |
| 3,887,003 | 6/1975 | Pulcer et al. | 165/142 |

*Primary Examiner*—Charles J. Myhre
*Assistant Examiner*—Theophil W. Streule, Jr.
*Attorney, Agent, or Firm*—Buell, Blenko & Ziesenheim

[57] ABSTRACT

A tube type recuperator is provided with a top manifold having a plurality of openings slidably receiving a plurality of ceramic tubes, a retainer ring fixed to each of said tubes within the top manifold and a flexible expansion compensator seal member sealingly engaging the top ends of the tubes within the retainer ring. Preferably the ceramic tubes are made up of inner and outer coaxial ceramic tubes each connecting to a separate top manifold.

5 Claims, 4 Drawing Figures

CERAMIC TUBE RECUPERATORS

This invention relates to ceramic tube recuperators and particularly to ceramic tube type recuperators in a top supported configuration using inner and outer tubes.

Recuperators have been used in furnace systems for recovery of heat from the furnace for many years. Typical of such recuperators is that shown in U.S. Pat. No. 3,602,296 and the references cited therein. These recuperators have been based on the use of metal tubes for recuperating transfer of heat. With the present energy crisis and the accompanying increase in fuel costs, the tendency has been to increase the air preheat temperature and thus to recuperate as much energy from the hot waste gas as possible. Unfortunately, however, as the air temperature increases, difficulties arise in selecting a satisfactory metallic material for use in such applications.

The present invention provides a solution to this problem of increased temperatures and to the problem of finding materials to withstand these higher temperatures and the erosion which occurs with them.

We have developed a tube type recuperator having at least one top manifold having a plurality of openings slidably receiving a plurality of ceramic tubes, a retainer ring fixed to each of said tubes within the top manifold and a flexible expansion compensator seal member sealingly engaging the top ends of the tube within the retainer ring. Preferably the ceramic tubes are made up of inner and outer coaxial ceramic tubes each connecting to a separate top manifold. In order to achieve maximum efficiency and heat recovery along with most economy in design, the double ceramic tube recuperator can be used in parallel or series with conventional metallic recuperators.

The foregoing general statement of invention has set out certain objects, purposes and advantages of this invention. Other objects, purposes and advantages of this invention will be apparent from a consideration of the following description and the accompanying drawings in which.

Figure 1:
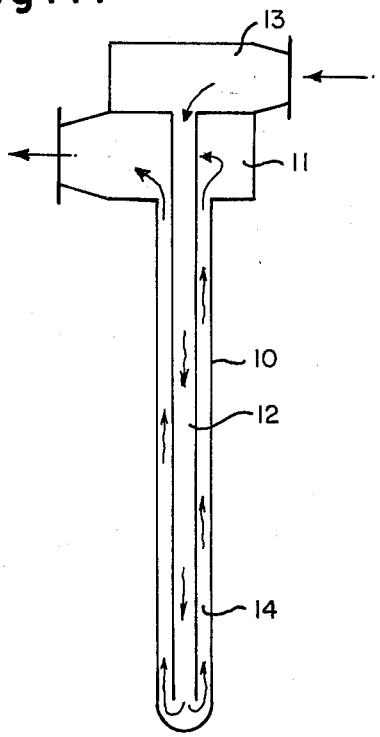
FIG. 1 is a section through a preferred form of ceramic reacuperator tube arrangement according to this invention.

Referring to the drawings we have illustrated an outer ceramic tube 10 closed at one end and open at the other end into plenum 11. An inner ceramic tube 12 open at both ends extends axially within the outer tube 10 from a second plenum 13 to a point adjacent the closed end of outer tube 10. The surface of outer tube 10 is exposed to the hot gas stream from the furnace and receives heat from this hot gas stream by convection and radiation. The gas to be heated entering from second plenum 13, flows through the inside of the inner tube 12, then out of the bottom open end 12 to the annulus 14 between inner tube 12 and outer tube 10. The heated gas then rises through this annulus to first plenum 11 from which it is withdrawn.

The details of the preferred method of setting and sealing the ceramic tubes 10 and 12 to this metal sheet bottom of the respective plenums is illustrated in FIG.

2. A tube holder 17 is welded to the tube sheet 16 forming the base of plenum 11 or plenum 13, and is lined with ceramic fiber 18. The ceramic tube 10 or 12, having a slightly enlarged head 10a or 12a is placed in holder 17. A tube fastener 19, in the form of a donut-shaped ring is threaded into the end of holder 17 to force the head 10a or 12a as the case may be into tight sealing contact with the holder 17 and ceramic fiber sealant 18. For the case of plenum 13, a layer of suitable castable 15 is added to protect the metal sheet from direct exposure to the hot gas.

Figure 3:
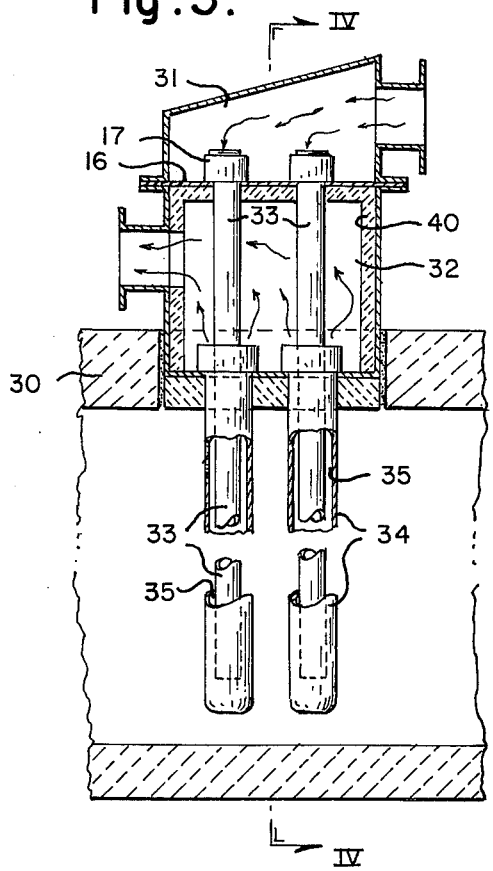
FIG. 3 is a section through a multiple tube arrangement of this invention.
Figure 4:
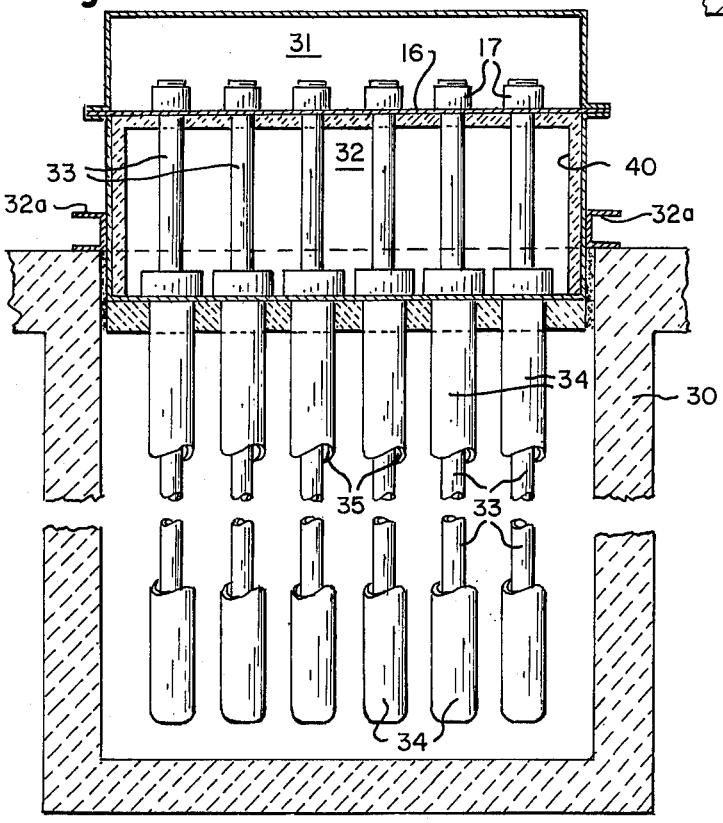
FIG. 4 is a section on the line IV-IV of FIG. 3.
Figure 2:
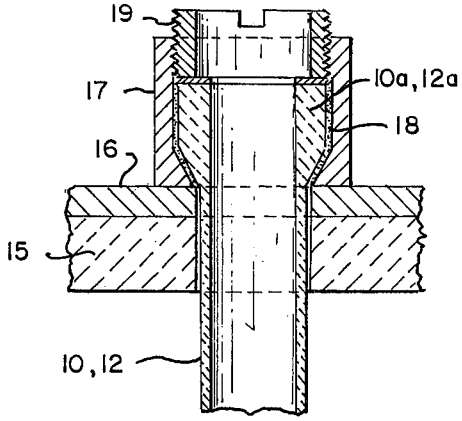
FIG. 2 is a fragmentary section of the top of a ceramic tube showing the sealing arrangement.

In FIGS. 3 and 4 we have illustrated another modification of the invention again based on the use of double axial ceramic tubes. In this embodiment we have illustrated a recuperator assembly within a supporting housing 30 of usual construction. Each recuperator assembly is made up of a pair of top superimposed plenums or manifolds 31 and 32 supported on housing 30 by support channels 32*a*. Depending from the upper manifold 31 are inner ceramic tube 33 which extend coaxially within outer ceramic tubes 34 depending from lower manifold 32 and terminate short of the outer ceramic tube 34. The air to be heated passes from manifold 31 down through inner ceramic tube 33 and up through the annulus 35 between inner ceramic tube 33 and outer ceramic tube 34 to lower manifold 32 from which it is carried to the point of use. The hot flue gases pass through housing 30 around ceramic outer tubes 34 in the usual manner of recuperators.

Preferably the manifolds 31 and 32 are insulated over their surfaces with a layer of rigid insulant 40 to retain the maximum heat efficiency.

In the foregoing specification, we have set out certain preferred practices and embodiments of our invention, however, it will be understood that this invention may be otherwise embodied within the scope of the following claims.

We claim:

1. A recuperator having a chamber traversed by combustion gases, the improvement comprising a plurality of outer ceramic outer tubes in contact with said combustion gases, said tubes being closed at their bottom ends and open to a first manifold at their top, a like plurality of inner ceramic tubes extending coaxially within the outer tubes and forming an annulus therebetween and open at the bottom ends spaced from the end of the outer tube, the upper end of said inner tubes open to a second manifold, whereby gases to be heated pass through said second manifold, through the inner tube, through the annulus between the inner and outer tubes and out through the first manifold, suspension means in each manifold removably and sealingly receiving and supporting said inner and outer tubes respectively in each said manifold.

2. A recuperator as claimed in claim 1 wherein each manifold has a bottom metal sheet carrying spaced apart suspension means in the form of annular metal tube holders welded thereto over openings in the manifold said tube holders each having an enlarged top opening and a small bottom opening receiving the end of the inner and outer ceramic tubes respectively, said ceramic tubes having an enlarged head fitting within said enlarged top opening and resting on the portion of the tube holder surrounding the bottom opening, and a ceramic fiber seal between the enlarged head and the tube holder.

3. A recuperator as claimed in claim 2 wherein the tube holders are threaded and annular fastner members are threaded into the holders on top of the tube ends to force them into sealing engagement with the ceramic fiber.

4. A recuperator as claimed in claim 2 wherein the top opening is in the form of a frustum of a cone tapering down to the small bottom opening and the enlarged head portion of each ceramic tube has a frusto-conical portion tapering into the tube body.

5. A recuperator as claimed in claim 1 wherein the manifolds are insulated.

* * * * *